US009045275B2

(12) United States Patent
Thery et al.

(10) Patent No.: US 9,045,275 B2
(45) Date of Patent: Jun. 2, 2015

(54) CONTAINER FOR DISPENSING A COMBINATION PRODUCT

(71) Applicant: Le Papillon Bioplan, New Brunswick, NJ (US)

(72) Inventors: Vivian Thery, New York, NY (US); Ryan M. Short, Somerset, NJ (US)

(73) Assignee: Le Papillon Bioplan, New Brunswick, NJ (US)

( * ) Notice: Subject to any disclaimer, the term of this patent is extended or adjusted under 35 U.S.C. 154(b) by 0 days.

(21) Appl. No.: 14/067,397

(22) Filed: Oct. 30, 2013

(65) Prior Publication Data

US 2015/0114857 A1 Apr. 30, 2015

(51) Int. Cl.

| | |
|---|---|
| ***B65D 81/32*** | (2006.01) |
| ***B65B 1/02*** | (2006.01) |
| ***B65B 3/02*** | (2006.01) |
| ***B65B 7/16*** | (2006.01) |

(52) U.S. Cl.

CPC ..... *B65D 81/3266* (2013.01); *B65B 1/02* (2013.01); *B65B 3/02* (2013.01); *B65B 7/16* (2013.01)

(58) Field of Classification Search

CPC ..... B65D 1/02; B65D 3/02; B65D 7/16; B65D 25/08; B65D 35/10; B65D 35/242; B65D 73/0057; B65D 75/366; B65D 81/3266; B65D 81/3272; A61J 1/2093; B65B 9/042; B65B 51/10

USPC ..... 206/219, 221, 462, 467, 469, 206/484–484.2; 222/94, 103, 105, 107; 53/452, 474

See application file for complete search history.

(56) References Cited

U.S. PATENT DOCUMENTS

| | | | | |
|---|---|---|---|---|
| 4,387,804 | A * | 6/1983 | Austin | 206/219 |
| 6,105,761 | A | 8/2000 | Peuker et al. | |
| 7,097,075 | B2 * | 8/2006 | Peuker et al. | 222/94 |
| 8,074,840 | B2 * | 12/2011 | Pennaneac'H | 222/103 |
| 8,151,984 | B2 * | 4/2012 | Braeder et al. | 206/219 |

(Continued)

FOREIGN PATENT DOCUMENTS

| | | | |
|---|---|---|---|
| FR | 2865192 | A1 * | 7/2005 |
| JP | 3059317 | | 3/1999 |

(Continued)

OTHER PUBLICATIONS

The International Search Report and Written Opinion, mailed on Feb. 10, 2015, in the corresponding PCT Application No. PCT/US2014/062899.

*Primary Examiner* — Bryon Gehman

(57) ABSTRACT

A container assembly comprising first and second compartments. The first compartment includes a base web having a formed portion and a flat portion, a lidding material joined to the flat portion and a frangible seal positioned between the base web and the lidding material. The second compartment includes first and second barriers that are sealed to one another at peripheral edges. The first barrier has an aperture through which the formed portion of the base web extends. An upper surface of the flat portion of the base web is joined to an interior surface of the first barrier, thereby encapsulating the frangible seal within the second compartment. When the frangible seal is broken, a passageway is provided for transferring material from the first compartment into the second compartment for mixing with a second material. The second compartment may then be opened to dispense the mixture.

24 Claims, 6 Drawing Sheets

(56) References Cited

U.S. PATENT DOCUMENTS

| | | | | |
|---|---|---|---|---|
| 8,857,663 | B2 * | 10/2014 | Scholvinck et al. | 206/484 |
| 2004/0065679 | A1 | 4/2004 | Peuker et al. | |

FOREIGN PATENT DOCUMENTS

| | | |
|---|---|---|
| JP | H11-227843 | 8/1999 |
| JP | 3119760 | 2/2006 |

* cited by examiner

CONTAINER FOR DISPENSING A COMBINATION PRODUCT

TECHNICAL FIELD

This disclosure relates to a container assembly for dispensing a combination product including at least two separately stored materials.

BACKGROUND

Containers for dispensing materials separately stored materials are known in the art. For example, U.S. Pat. No. 7,097,075, which is hereby incorporated by reference herein in its entirety, discloses a device comprising two films that are sealed to one another and that define two serially-positioned chambers each containing one of two substances to be mixed together. Upon compressing one of the two chambers, a first substance can be flowed thorough a transition zone into the second chamber which is deformably expandable to accommodate both substances. The second chamber can then be compressed to dispensed a mixture of the two substances via a dispensing zone.

While the device disclosed by U.S. Pat. No. 7,097,075 and other prior art dispensers provide advantageous features, they also have limitations. For example, the device disclosed by U.S. Pat. No. 7,097,075 is limited to providing two chambers which are necessarily of identical material construction and quite similar geometries. These limitations are particularly disadvantageous for application requiring the mixing and/or dispensing of combination products formed from two very different materials. In this case, for example, it may be necessary to provide a device with chambers or compartments that have quite different geometries according to the relative quantities of materials provided and according to overall packaging and display requirements. In addition, the chemical properties of the different materials to be dispensed may require different compatible materials to be used to form each of the chambers.

SUMMARY

Briefly, aspects of the present disclosure are directed to a container assembly for dispensing a combination product including at least two separately stored materials. The materials are isolated from one another in first and second compartments until the point of usage, at which time a compression of the first compartment causes a first material in the first compartment to be transferred and mixed with a second material in the second compartment before the mixture is dispensed.

A first aspect of the present disclosure includes a container assembly comprising the first and second compartments. The first compartment includes: a base web having a formed portion and a flat portion, a lidding material sealably joined to a bottom surface of the flat portion and a frangible seal positioned between the base web and the lidding material. The second compartment includes least a first barrier and a second barrier that are sealed to one another at peripheral edges of opposing interior surfaces. The first barrier also has an aperture through which the formed portion of the base web is outwardly positioned. An upper surface of the flat portion of the base web is sealably joined to the interior surface of the first barrier, thereby encapsulating the frangible seal within the second compartment. When the frangible seal is broken, a passageway is provided for transferring material from the first compartment to the second compartment for mixing with a second material. The second compartment may then be opened to dispense the mixture.

In a second aspect of the present disclosure, each of the base web, the lidding material and/or the first and second barriers is preferably formed as a laminate comprising one or more materials for example selected from but not limited to the group consisting of: 1) polyester including polyethylene terephthalate (PET), amorphous polyethylene terephthalate (APET), recycled PET (RPET), and. PET glycol-modified (PETG); 2) polypropylene (PP)); 3) high-density polyethylene (HDPE), medium-density polyethylene (MDPE), low-density polyethylene (LDPE) and linear low-density polyethylene (LLDPE)); 4) ethylene vinyl acetate (EVA)); 5) polyvinyl chloride (PVC),); 6) polyvinylidene chloride (PVDC); 7) aluminum and 8) nylon. In particular, materials at laminate surfaces that are sealably joined are preferably selected to comprise compatible polymers among this group, and more preferably, identical polymers from this group.

A third aspect of this disclosure includes a method of making a container device for mixing and dispensing two materials. A first one of the two materials is provided in a formed portion of a base web. A lidding material is sealed to a flat portion of the base web to form a first compartment of the container. A portion of the seal between the lidding material and the base web is formed to provide a frangible seal. A second compartment is provided to include at least a first barrier and a second barrier each having opposing interior surfaces. The formed portion of the base web is positioned outwardly through an aperture in the first barrier, and an upper surface of the flat portion of the base web is joined to the interior surface of the first barrier. A second one of the two materials is provided in a cavity between the first and second barriers of the second compartment, and the cavity is sealed. The frangible seal is formed to be broken when the first compartment is deformed, and to then provide a passageway for transferring the first material from the first compartment to be mixed with the second material in the second compartment.

This SUMMARY is provided to briefly identify some aspects of the present disclosure that are further described below in the DESCRIPTION. This SUMMARY is not intended to identify key or essential features of the present disclosure nor is it intended to limit the scope of any claims.

The term "aspects" is to be read as "at least one aspect". The aspects described above and other aspects of the present disclosure described herein are illustrated by way of example(s) and not limited in the accompanying drawing.

BRIEF DESCRIPTION OF THE DRAWING

A more complete understanding of the present disclosure may be realized by reference to the accompanying drawing in which.

DESCRIPTION

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Unless otherwise explicitly specified herein, the drawings are not drawn to scale.

We now provide some non-limiting, illustrative examples that illustrate several operational aspects of various arrangements and alternative embodiments of the present disclosure.

Figure 1:
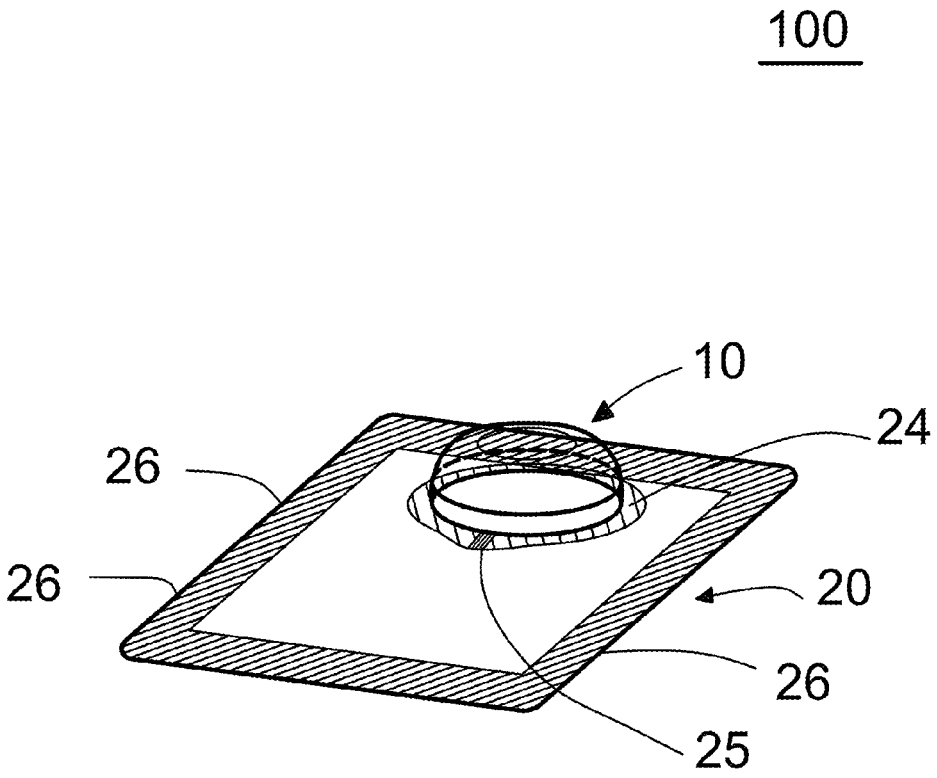
FIG. 1 is a perspective diagram schematically illustrating a container assembly in accordance with aspects of the present disclosure.
Figure 2:
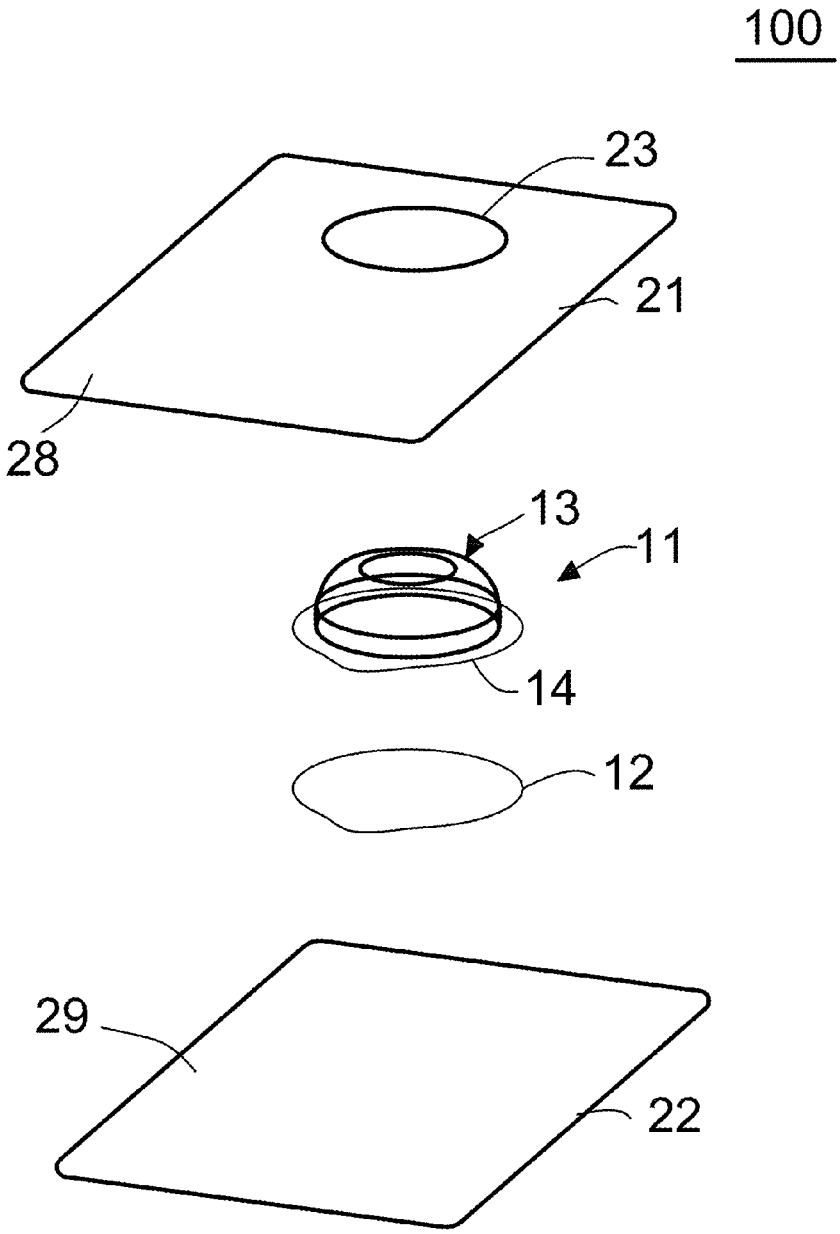
FIG. 2 is an exploded perspective diagram further illustrating the container assembly of FIG. 1.

Aspects of the present disclosure describe a container assembly for dispensing a combination product including at least two separately stored materials. With reference to FIGS. 1 and 2, an illustrative container assembly 100 includes a first compartment 10 for holding a first of the at least two separately stored materials and a second compartment 20 for holding a second of the at least two separately stored materials. The first compartment includes a base web 11 having a formed portion 13 defining a cavity and a flat portion 14. A lidding material 12 is joined to a bottom surface of the flat portion 14.

Each of the base web 11 and the lidding material 14 may preferably be formed as laminates including one or more materials for example selected from but not limited to the group consisting of: 1) polyester including polyethylene terephthalate (PET), amorphous polyethylene terephthalate (APET), recycled PET (RPET), and. PET glycol-modified (PETG); 2) polypropylene (PP)); 3) high-density polyethylene (HDPE), medium-density polyethylene (MDPE), low-density polyethylene (LDPE) and linear low-density polyethylene (LLDPE)); 4) ethylene vinyl acetate (EVA)); 5) polyvinyl chloride (PVC),); 6) polyvinylidene chloride (PVDC); 7) aluminum and 8) nylon. The base web 11 may alternatively include from a single homogeneous material, and may be preferably produced as a thermoform on conventional form and seal equipment used, for example, in the production of so-called "blister pack" packaging.

The lidding material 12 is preferably formed as a laminate film suitable to be heat sealed on the bottom surface of the flat portion 14 of the base web 11. The laminate film also preferably includes a foil layer (for example, aluminum foil) as a barrier layer, so that the seal on the bottom surface of the flat portion 14 of the base web 11 functions as a hermetic seal. A portion of the hermetic seals defines a frangible seal 25, which can be ruptured by compressing the formed portion 13 to open a passageway to allow the first material for flow outside of the first compartment 10. The frangible seal may be most easily formed, for example, by forming the lidding material 12 from a conventional peelable seal material, and diminishing the time, temperature and/or pressure applied to form the portion of the seal that defines the frangible seal 25, in order that this portion will be weakened and fail more readily under pressure as the formed portion 13 is compressed.

The second compartment 20 is formed from a first barrier 21 and a second barrier 22. An aperture 23 is provided in the first barrier 21, through which the formed portion 13 of the base web 11 is inserted outwardly away from an interior surface 28 of the first barrier 21. Each of the first barrier 21 and the second bather 22 are preferably formed as a laminate film, and from materials for example selected from but not limited to the group consisting of: 1) polyester including phthalate (PET), amorphous polyethylene terephthalate (APET), recycled PET (RPET), and. PET glycol-modified (PETG); 2) polypropylene (PP)); 3) high-density polyethylene (HDPE), medium-density polyethylene (MDPE), low-density polyethylene (LDPE) and linear low-density polyethylene (LLDPE)); 4) ethylene vinyl acetate (EVA)); 5) polyvinyl chloride (PVC),); 6) polyvinylidene chloride (PVDC); 7) aluminum and 8) nylon.

After the formed portion 13 of the base web 11 is inserted through the aperture 23 in the first barrier 21, an upper surface of the flat portion 14 of the base web 11 is heat sealed to the interior surface 28 of the first barrier 21. In order to ensure that this heat seal is hermetically sealed, the materials selected for the upper surface of the flat portion 14 and the interior surface 28 of the first barrier 21, and may preferably comprise identical polymers. Because other material properties may be of importance (for example, including the elasticity of the formed portion 13 in compression, the base web 11, first barrier 21 and second barrier 22 may be formed as laminates incorporating several distinct material layers. This may also be advantageous, for example, under conditions where chemical properties of the first and second materials place specific and distinct material requirements on the interior surfaces of the first and second compartments 10, 20.

After the base web 11 has been sealed to the first barrier 21, the first barrier 21 and second barrier 22 may preferably be welded along peripheral seams 26 to form a sealed interior cavity within the second compartment 20. Prior to welding at least a final peripheral seam 26 or providing some alternate means for sealing this seam 26 (for example, alternatively by adhesive sealing), the second material second material may be provided within the interior cavity of the second compartment 20.

Figure 4A:
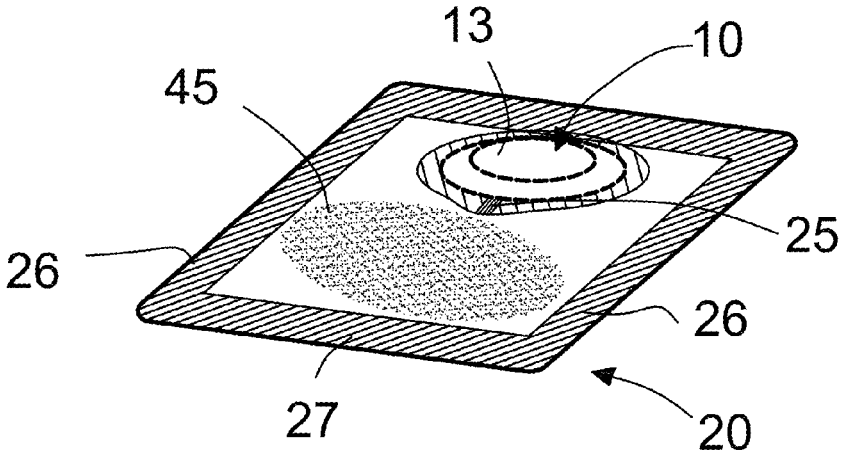
FIG. 4A is a perspective diagram schematically illustrating the container assembly of FIG. 1 in a second operational state.
Figure 4B:
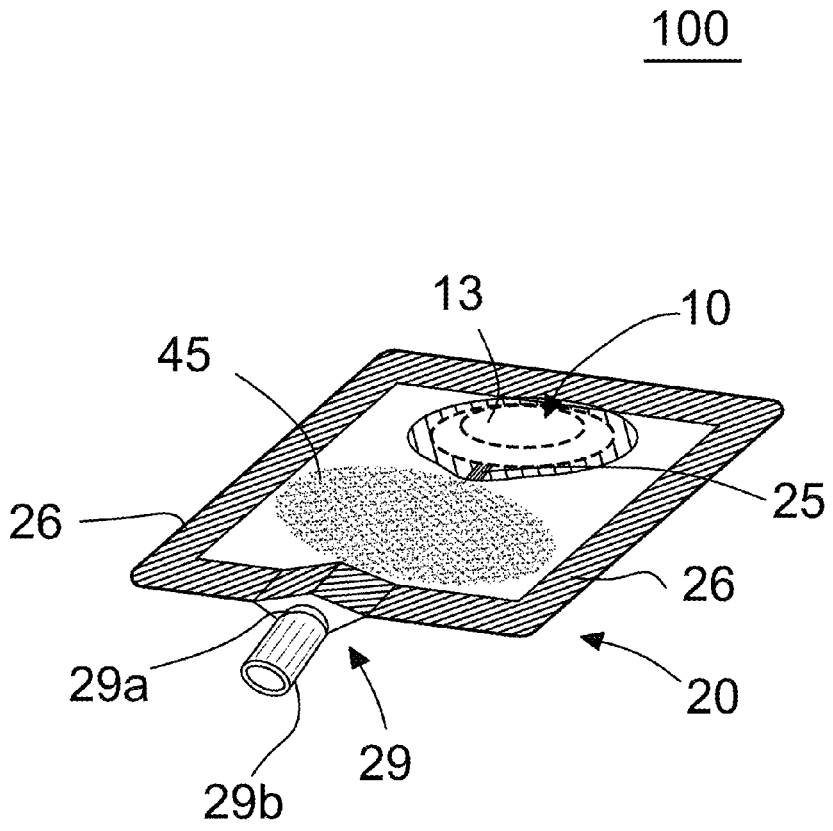
FIG. 4B is a perspective diagram schematically illustrating an alternate embodiment of container assembly of FIG. 4A.

The second compartment 20 may also preferably be provided with one or more opening features to enable the first and second materials to be dispensed from the second compartment. As illustrated in FIG. 4A, for example, the opening features may include slits 27 to facilitate the tearing of a peripheral seam 26 away from the second compartment 20 in order to obtain access to the interior cavity of the second compartment 20. Alternatively, the opening features may include diamond notches, peelable-type openings (which, for example, may permit the flexible barriers 21, 22 to be peeled apart over portions of one or more peripheral seams 26 to obtain access to the interior cavity of the second compartment 20), and micro perforations, or be provided as a reclosable fitment. As illustrated for example in FIG. 4B, the opening may be provided as redo sable fitment 29 including a spout 29*a* or other conventional means for directing the dispensed materials. In FIG. 4B, the reclosable feature comprises a cap 29*b* applied over the spout 29*a*.

Figure 3:
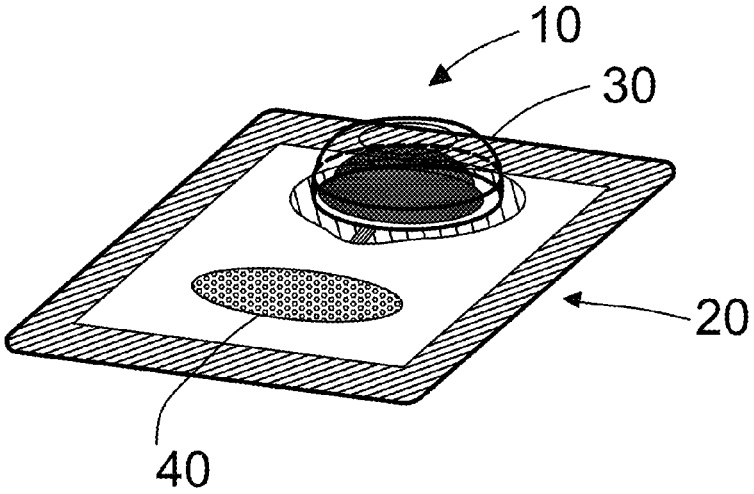
FIG. 3 is a perspective diagram schematically illustrating the container assembly of FIG. 1 in a first operational state.

FIGS. 3 and 4A illustrate how the container assembly 100 of FIGS. 1, 2 may be used. In a first operational state illustrated in FIG. 3, the first material 30 is stored within the first compartment 10 and the second material 40 is stored within the second compartment 20. As the two compartments 10, 20 are hermetically sealed with respect to one another, the first and second materials 30, 40 are separately contained without contacting one another.

FIG. 4 illustrates a second operational state for the container assembly 100, in which the formed portion 13 of the first compartment 10 has been compressed, thereby rupturing the frangible seal 25 and causing the outflow of the material 30 from the first compartment 10 into the second compartment 20 to interact with the material 40 to form the mixture 45. Mixing can be enhanced, for example, by a user that shakes the container assembly 100 and/or manipulates the flexible barriers 21, 22 to promote mixing. For some second materials 40 that are absorbent, active mixing may be unnecessary. Once mixing and/or absorption has been completed, a peripheral seam 26 may then be removed by tearing the second compartment 20 along one or more of slits 20 in order to dispense the mixture 45.

In FIGS. 1-4B, the second compartment 20 is illustrated as rectangular and pillow-shaped. One of skill in the art at the time of this disclosure will readily recognize that a great number of other geometries may be selected for the second compartment 20 without departing from the principles of the present disclosure, in accordance for example with considerations including the nature of the materials to be dispensed and physical positioning of the container assembly 100 in a product or sales environment. For example, a portion of the second compartment 20 may be expanded via gusseting or other means in order to enable the container assembly 100 to be conveniently stored in a vertical position. In addition or alternatively, the geometry (for example, shape and/or size) of the compartment 20 may be altered relative to the geometry of the compartment 100 according to the characteristics of the materials 30, 40. For example, if the second material 40 is a non-liquid material such as a towlette, the shape and thickness of the compartment 20 may be significantly altered from the examples depicted in FIGS. 1-3.

Consistent with principles of the present disclosure, it is anticipated that first materials contained within the first compartment 10 of the container assembly 100 may include materials selected from the group consisting of lotions, creams, gels, waxes, oils, paints, foams, glues, solvents, water-based solutions and powders, and that materials contained within the second compartment 20 of the container assembly 100 may include materials selected from the group consisting of lotions, creams, gels, waxes, oils, paints, foams, glues, solvents, water-based solutions and powders or the group consisting of pills, pads, towlettes, patches, gauze and paper. Product applications consistent with principles of the present disclosure may, for example, include cosmetic applications including two or more part cosmetic formulations in liquid and/or powder form, and including pads and/or other absorbent materials to be dispensed after absorbing one or more formulations within the container assembly 100. In addition, product applications may for example include pharmaceutical combinations providing a bandage with a disinfectant, active pharmaceutical ingredients to be mixed at a time of use, and/or pills in combination with a fluid carrier for environments where water quality is suspect. Multi-part chemical application including, for example, epoxy glues are also contemplated within the present disclosure, as are food applications including for example, vitamins provided in combination with liquids and multi-part protein shakes.

Figure 5:
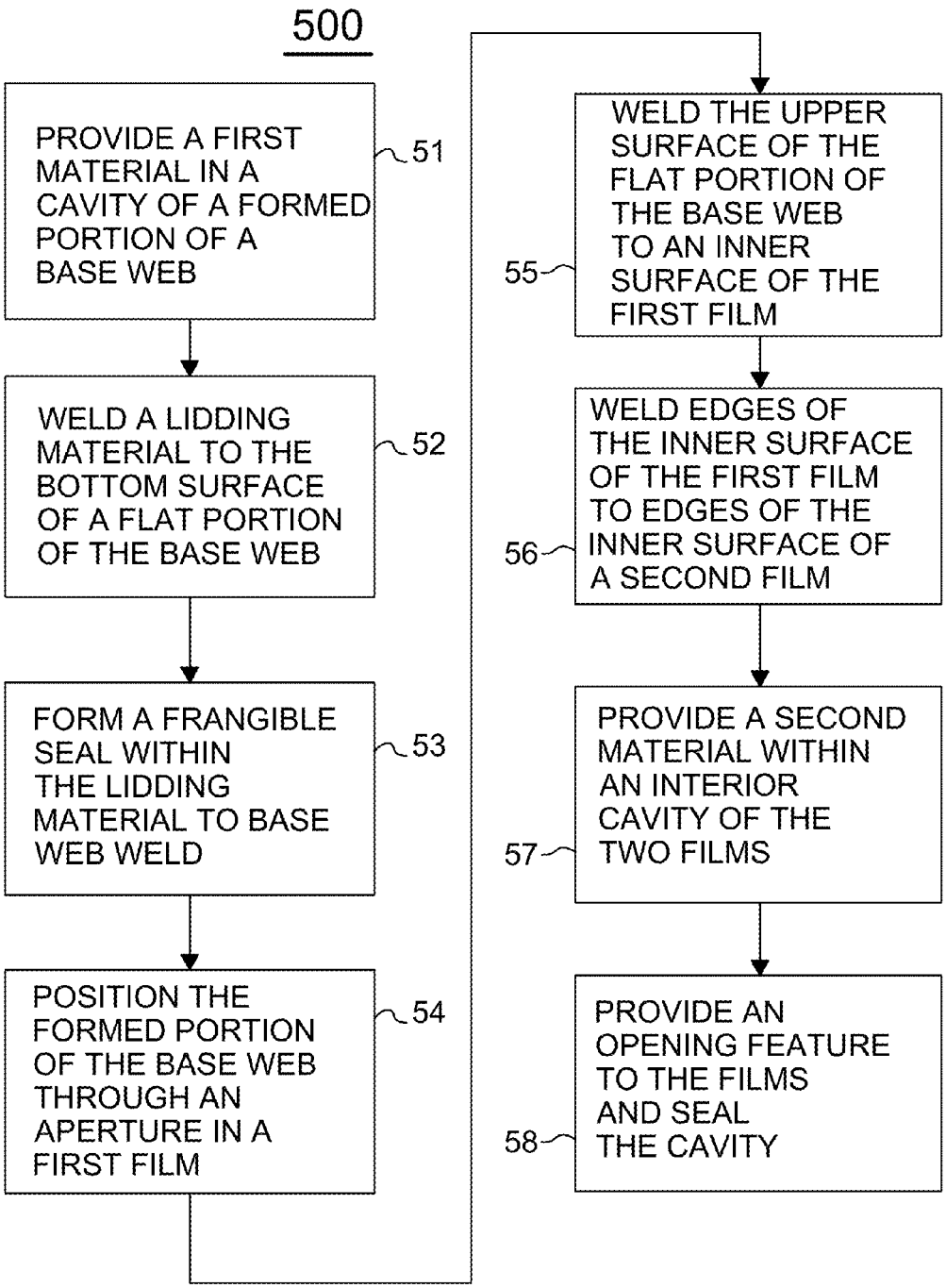
FIG. 5 is a flow diagram illustrating a method of making a container assembly according to aspects of the present disclosure.

FIG. 5 provides a flow diagram illustrating an manufacturing process 500 for making a container assembly in accordance with aspects of the present disclosure. At step 51 of the process 500, a first material 30 is provided within the cavity of the formed portion 13 of the base web 11. The lidding material 12 is then heat sealed to a bottom surface of the flat portion 14 of the base web 11 at step 52. The frangible seal 25 is provided in a portion of the heat seal at step 53 by diminishing the time, temperature and/or pressure applied to form this portion of the seal.

At step 54, the formed portion 13 of the base web 11 is inserted outwardly through an aperture 23 in a first barrier 21, and then an upper surface of the flat portion 14 is heat sealed to an inner surface of the first barrier 21 near a periphery to the aperture 23 at step 55. At step 56, inner surfaces at peripheral edges of the first barrier 21 and the second barrier 22 are welded to form a welded peripheral seams 26, and a second material 40 is provided to an interior cavity of the second compartment 20 via a remaining non-welded peripheral seam 26. The remaining non-welded seam 26 is sealed (for, example, by welding or adhesive means), and an opening feature is provide to the second compartment 20 at step 58 to facilitate dispensing of the mixture 45.

At this point, while we have presented this disclosure using some specific examples, those skilled in the art will recognize that our teachings are not so limited. Accordingly, this disclosure should be only limited by the scope of the claims attached hereto.

We claim:

1. A container assembly comprising:

a first compartment including:

a base web having a formed portion defining a cavity and a flat portion defining a planar surface, a lidding material sealably joined to a bottom surface of the flat portion of the base web, and a frangible seal positioned between the base web and the lidding material; and a second compartment including at least a first barrier and a second barrier, the first and second barriers each having opposing interior surfaces and the first barrier having an aperture, wherein the formed portion of the base web is positioned outwardly through the aperture in the first barrier, wherein an upper surface of the flat portion of the base web is sealably joined to the interior surface of the first barrier, and wherein the frangible seal is configured when broken to provide a passageway for transferring material from the first compartment to the second compartment.

2. The container assembly of claim 1, wherein the first barrier and the second barrier are sealably joined to form the second compartment.

3. The container assembly of claim 2, wherein the first barrier and the second barrier each comprise a laminate material.

4. The container assembly of claim 3, wherein the laminate materials comprise one or more materials selected from the group consisting of polyethylene terephthalate (PET), amorphous PET (APET), recycled PET (RPET), PET glycol-modified (PETG), polypropylene (PP), high-density polyethylene (HDPE), medium-density polyethylene (MDPE), low-density polyethylene (LDPE), linear low-density polyethylene (LLDPE), ethylene vinyl acetate (EVA), polyvinyl chloride (PVC), polyvinylidene chloride (PVDC), aluminum, and nylon.

5. The container assembly of claim 2, wherein the second compartment is pillow-shaped and further comprises peripheral seams that join the first and second barriers in proximity to rectangular edges of the second compartment.

6. The container assembly of claim 5, wherein the second compartment is gusseted along at least one of the rectangular edges.

7. The container assembly of claim 5, wherein the second compartment comprises at least one opening feature.

8. The container assembly of claim 7, wherein the at least one opening feature is a tear feature selected from the group consisting of slits, diamond notches, and micro perforations.

9. The container assembly of claim 7, wherein the at least one opening feature comprises a reclosable fitment.

10. The container assembly of claim 9, wherein the reclosable fitment further comprises a spout.

11. The container assembly of claim 1, wherein the base web comprises a flexible thermoformed plastic.

12. The container assembly of claim 11, wherein the flexible thermoformed plastic comprises a laminate material.

13. The container assembly of claim 11, wherein the flexible thermoformed plastic comprises one or more materials selected from the group consisting of polyethylene terephthalate (PET), amorphous PET (APET), recycled PET (RPET), PET glycol-modified (PETG), polypropylene (PP), high-density polyethylene (HDPE), medium-density polyethylene (MDPE), low-density polyethylene (LDPE), linear low-density polyethylene (LLDPE), ethylene vinyl acetate (EVA), polyvinyl chloride (PVC), polyvinylidene chloride (PVDC), aluminum, and nylon.

14. The container assembly of claim 1, wherein the lidding material comprises a laminate film.

15. The container assembly of claim 14, wherein the laminate film comprises one or more materials selected from the group consisting of polyethylene terephthalate (PET), amorphous PET (APET), recycled PET (RPET), PET glycol-modified (PETG), polypropylene (PP), high-density polyethylene (HDPE), medium-density polyethylene (MDPE), low-density polyethylene (LDPE), linear low-density polyethylene (LLDPE), ethylene vinyl acetate (EVA), polyvinyl chloride (PVC), polyvinylidene chloride (PVDC), aluminum, and nylon.

16. The container assembly of claim 14, wherein the laminate film comprises an aluminum foil.

17. The container assembly of claim 1, further comprising:

a first dispensable material sealably provided within the first compartment; and a second dispensable material sealably provided within the second compartment.

18. The container assembly of claim 17, wherein the first dispensable material comprises a material selected from the group consisting of lotions, creams, gels, waxes, oils, paints, foams, glues, solvents, water-based solutions and powders.

19. The container assembly of claim 17, wherein the second dispensable material comprises a material selected from the group consisting of lotions, creams, gels, waxes, oils, paints, foams, glues, solvents, water-based solutions and powders.

20. The container assembly of claim 17, wherein the second dispensable material comprises a material selected from the group consisting of pills, pads, towlettes, patches, gauze and paper.

21. A method of making a container device for mixing and dispensing two materials, the method comprising the steps of:

providing a first one of the two materials in a base web having a formed portion defining a cavity and a flat portion defining a planar surface, sealably joining a lidding material to a bottom surface of the flat portion of the base web to form a first compartment that encloses the first material, wherein a portion of the seal between the lidding material and the bottom surface of the base web comprises a frangible seal;

providing a second compartment including at least a first barrier and a second barrier each having opposing interior surfaces;

providing an aperture in the first barrier;

positioning the base web outwardly through the aperture in the first barrier;

sealably joining an upper surface of the flat portion of the base web to the interior surface of the first barrier; and sealably enclosing a second one of the two materials within the second compartment, whereby, upon deforming the formed portion of the base web, the frangible seal is broken to provide a passageway for transferring the first material from the first compartment to the second compartment.

22. The method of claim 21, wherein the step of sealably enclosing the second material further comprises the step of:

sealably joining the first barrier and the second barrier of the second compartment, wherein the first barrier and the second barrier each comprise a flexible film.

23. The method of claim 22, wherein the step of sealably joining the first barrier to the second barrier comprises the step of welding the inner surface of the first barrier to the inner surface the second barrier at one or more peripheral edges of the first and second barriers.

24. The method of claim 21, wherein the step of sealably joining the lidding material to the base web produces a hermetic seal.

* * * * *